US007762224B2

(12) United States Patent
Rörig et al.

(10) Patent No.: US 7,762,224 B2
(45) Date of Patent: Jul. 27, 2010

(54) SWITCHABLE SUPPORT ELEMENT FOR A VALVE TRAIN OF AN INTERNAL COMBUSTION ENGINE

(75) Inventors: Bodo Rörig, Weisendorf (DE); Joachim Seitz, Reundorf (DE); Robert Heinemann, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 210 days.

(21) Appl. No.: 12/074,782

(22) Filed: Mar. 6, 2008

(65) Prior Publication Data

US 2008/0223326 A1 Sep. 18, 2008

(30) Foreign Application Priority Data

Mar. 13, 2007 (DE) ..... 10 2007 011 893

(51) Int. Cl.
*F01L 1/14* (2006.01)

(52) U.S. Cl. ..... 123/90.52; 123/90.16; 123/90.55

(58) Field of Classification Search ..... 123/90.16, 123/90.52, 90.55; 74/559, 567, 569
See application file for complete search history.

(56) References Cited

U.S. PATENT DOCUMENTS 4,218,995 A * 8/1980 Aoyama ..... 123/90.55

* cited by examiner

*Primary Examiner*—Zelalem Eshete
(74) *Attorney, Agent, or Firm*—Charles A. Muserlia

(57) ABSTRACT

A switchable support element (1) comprising a housing (2) in whose bore (4) an axially displaceable pressure piston (7) extends, said support element (1) comprising at least one coupling element (8) for an optional coupling of the pressure piston (7) in its axially extended position relative to the housing (2), said pressure piston (7) being biased in an outward direction from the housing (2) by at least one lost motion spring (9). The housing (2) ends in a solid bottom (10) which comprises a central aperture (12) that starts from its inner side (11) and is intersected radially by a reception (13) of the housing (2) comprising the at least one coupling element (8), the pressure piston (7) extending with an outer peripheral surface (14) of its head-side guide section (15) directly in the bore (4) of the housing (2), said guide section (15) connects in bore direction to a radially reduced center piece (16) that merges into a head-distal end piece (17) that is guided in the aperture (12) of the bottom (10), the lost motion spring (9) surrounds the center piece (16) and is supported at one end on the inner side (11) of the bottom (10) while acting at a further end against an underside (18) of the guide section (15), and the end piece (17) comprises an entraining surface (19) for at least one coupling element (8) for achieving coupling.

13 Claims, 2 Drawing Sheets

SWITCHABLE SUPPORT ELEMENT FOR A VALVE TRAIN OF AN INTERNAL COMBUSTION ENGINE

FIELD OF THE INVENTION

The invention concerns a switchable support element for a valve train of an internal combustion engine, said switchable support element comprising a pot-shaped housing that can be arranged with an outer peripheral surface in a reception of the internal combustion engine and in whose bore an axially displaceable pressure piston extends, a head of the pressure piston projecting beyond an edge of the housing, at least one coupling element for an optional coupling of the pressure piston in an axially extended position relative to the housing being associated to the support element, and said pressure piston being biased in a an outward direction from the housing by at least one lost motion spring.

BACKGROUND OF THE INVENTION

Prior art switchable support elements are configured with a relatively small overall height as sufficient design space is available in radial direction for accommodating coupling elements (s. DE 10 2005 003 745 A1) or for arranging components "next to one another". In this cited prior art complex, supplementary modifications to the cylinder head, for example, become necessary for integrating the coupling elements.

Besides this, it is observed that, in prior art support elements of the switchable type, the coupling elements are integrated as a rule in the pressure piston (inner part), so that, in the switched-off state they oscillate together with the pressure piston. This has a detrimental effect on the moving mass of the valve train.

Furthermore, it is apparent that such support elements of small overall height and a relatively large diameter cannot be installed in hitherto existing bores for support elements in cylinder heads because these bores have a very small diameter and a large design depth.

OBJECTS OF THE INVENTION

It is therefore an object of the invention to provide a switchable support element of the pre-cited type in which the aforesaid disadvantages are eliminated.

This and other objects and advantages of the invention will become obvious from the following detailed description.

SUMMARY OF THE INVENTION

The invention achieves the above objects by the fact that the housing ends in a solid bottom which comprises a central aperture starting from an inner side of the housing, the aperture is intersected in radial or secant relationship by a reception of the housing comprising the at least one coupling element, the pressure piston extends with an outer peripheral surface of a head-side guide section directly in the bore of the housing, said guide section connects in bore direction to a radially reduced center piece that merges into a head-distal end piece that is guided in the aperture of the bottom, the lost motion spring surrounds the center piece while being supported at one end on the inner side of the bottom and acting at a further end against an underside of the guide section, and the end piece comprises an entraining surface for the at least one coupling element for achieving coupling.

Thus a switchable support element is provided that, on the one hand, due to its "stacked" design is very "slim" and that, on the other hand, can be easily installed, for instance, in already existing, relatively deep receptions in the cylinder head, and in which, advantageously, existing hydraulic medium ducts can be used.

The invention particularly concerns a switchable support element for mounting one end of a finger lever. But it is conceivable and intended to use the switchable support element likewise for a variable rocker arm mounting or for mounting a lever-member of a switchable lever valve train.

Due to the fact that the coupling elements, which according to a preferred embodiment, are configured in the form of piston-like, stepped slides, are arranged in the bottom of the housing, they do not oscillate with the support element during the uncoupled state. The moving valve train mass is thus minimized.

The proposed housing may, for instance, have a solid configuration but making it by extrusion molding is likewise conceivable and intended.

In the end, the pressure piston of the invention has a three-piece construction consisting of a head-side guide section that connects to a rod-like center piece that is surrounded by a lost motion spring (at least one coil compression spring), the center piece merging on the bottom-side with an end piece having, for example, the same diameter and being made integrally therewith.

The entraining surface in the end piece may be, for example, an annular groove or an annular segment into which, for example, the stepped coupling pistons can be displaced from the housing radially inward for coupling (base circle phase of the cam). In this way, a rotation-preventing device for the entire pressure piston relative to the housing may, but must not, be dispensed with. Alternatively, engagement surfaces like windows, bores etc. for the coupling pistons in the end piece are also feasible. If necessary, the coupling pistons may also be made to be displaceable under an end-side frontal surface of the end piece.

It goes without saying that the scope of the invention also extends to a solution providing only one slide as a coupling element or a solution in which the number of slides is >2.

It is advantageous and appropriate to make the center piece together with the end piece out an easy-to-generate rod-shaped piece (if appropriate, also out of plastic) and connect it subsequently to the guide section. To compensate for any errors of alignment etc., advantageously, a snap ring connection or the like can be used in this region. If necessary, it is also conceivable and within the scope of the invention to provide a screw connection or an interference fit. Other possible joining methods are welding, soldering, gluing or the like.

It is particularly advantageous to configure the reception for the coupling elements in the bottom as a through-bore. This enables the generation of this bore in a single work step with a single tool.

In a further development of the invention, it is proposed to bias the coupling pistons by a bent metal spring surrounding their outer front ends after the manner of a belt. Alternatively, the spring may also surround almost the entire outer peripheral region of the housing and be merely slit at one end.

In case the slide serving as a coupling element has a stepped configuration, a simple anti-rotation device can be realized through the ends of the bent spring constituting the spring means.

For displacing the slide forming the coupling element in its uncoupling direction radially outward, the invention advantageously provides the use of a hydraulic medium for this purpose. The hydraulic medium can be routed through a simple cross-channel, starting from the outer periphery of the housing, into an annular space in front of inner end faces of the slides serving as coupling elements. However, it is both conceivable and intended to load the slides in their coupling direction hydraulically and to use a compression spring force or the like for loading in uncoupling direction. If appropriate, a loading through hydraulic medium may also be used in both directions.

An axial displacement limitation for the pressure piston out of the housing for creating a coupling situation is also provided by the invention. For this purpose, the pressure piston comprises in the region of its end piece, a radially protruding collar that cooperates in a stop position with an annular step in the aperture of the bottom. This also creates an anti-loss device for the pressure piston, for example, during transportation and assembly. It is also conceivable and intended to implement an adjustment of the coupling lash in the aforesaid region (radial collar/annular step). For this purpose, for instance, the radial collar or the annular step may be configured, for example, with a variable thickness, or separate disks or the like may be arranged in this region after having measured the coupling lash previously in the pre-assembled state (s. WO 03/067038 A1).

It is further proposed to arrange a radially protruding anti-rotation element such as a ball or a pin or the like in the outer periphery of the housing. This element then cooperates with a corresponding counter surface when installed in the cylinder head.

Finally, a hydraulic lash adjuster may be installed in the support element. This can extend, for instance, in the region of the guide section and comprise the head for the contact of the lever.

BRIEF DESCRIPTION OF THE DRAWING

The invention will now advantageously be described more closely with reference to the appended drawing in which.

DETAILED DESCRIPTION OF THE DRAWING

Figure 1:
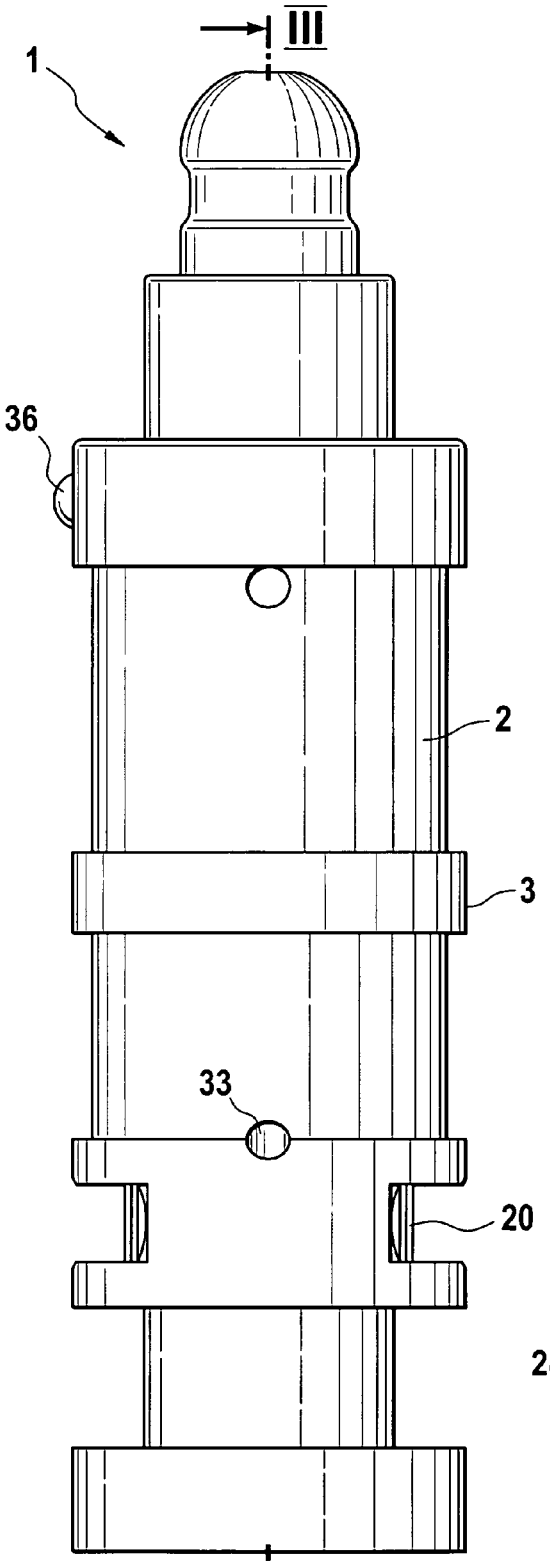
FIG. 1 is a side view of a support element.

The figures show a switchable support element 1 for a valve train of an internal combustion engine. This support element 1 comprises a pot-shaped housing 2 in whose bore 4 an axially displaceable pressure piston 7 is installed. The support element 1 can be installed through an outer peripheral surface 3 of its housing 2 into a reception of a cylinder head.

The aforesaid pressure piston 7 of the support element 1 consists of three components, viz., an upper guide section 15 having a head 5 for directly supporting a finger lever, said guide section 15 connecting to a center piece 16 that merges with an end piece 17. The center piece 16 is made integrally with the end piece 17 out of simple rod material. The aforesaid components are connected in the region of an underside 18 of the guide section 15. For this purpose, a stub-like extension 30 projects from the underside 18 of the guide section 15. The center piece 16 is plugged with its reception 31 onto the extension 30. The aforesaid components are connected through a simple snap ring connection 32.

The pressure piston 7 is guided through an outer peripheral surface 14 of its guide section 15 in the bore 4 of the housing 2. A further guidance relative to an aperture 12 is implemented in the region of the end piece 17. The aperture 12 extends in the represented solid region of a bottom 10 of the housing 2.

As can be seen further, the guide section 15 comprises a hydraulic lash adjuster 37, that needs no further specification here, whose inner part thus comprises the head 5.

Figure 3:
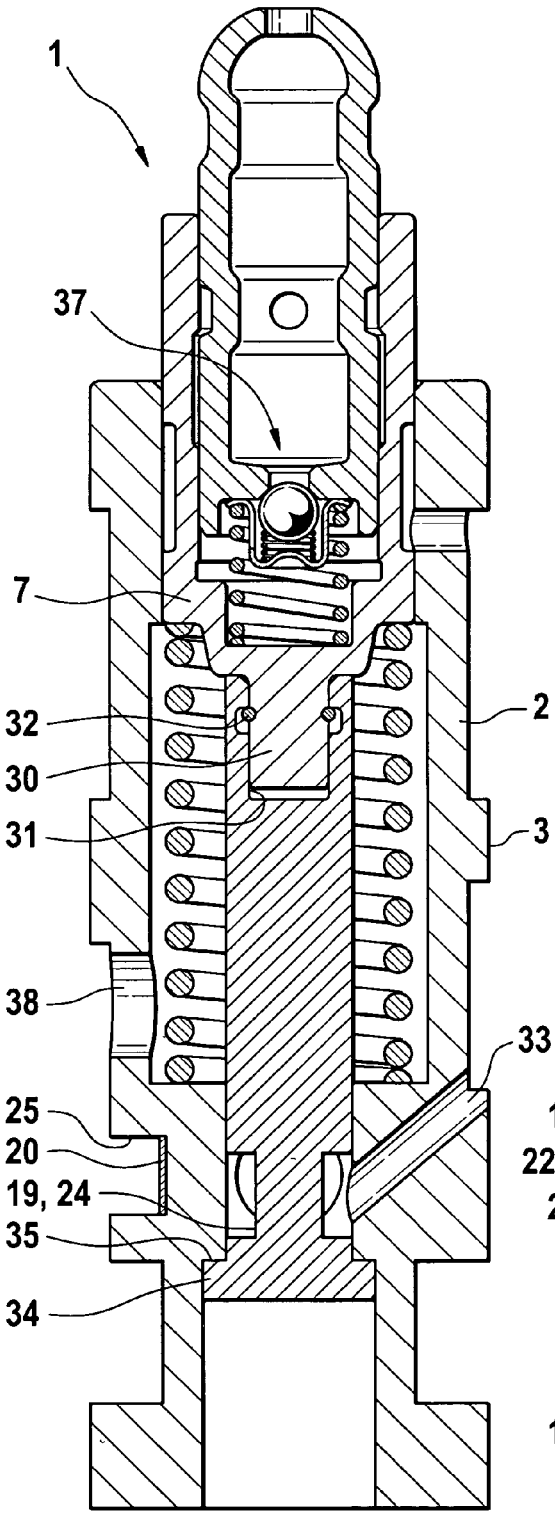
FIG. 3 shows a sectional view along line III-III of FIG. 1.
Figure 4:
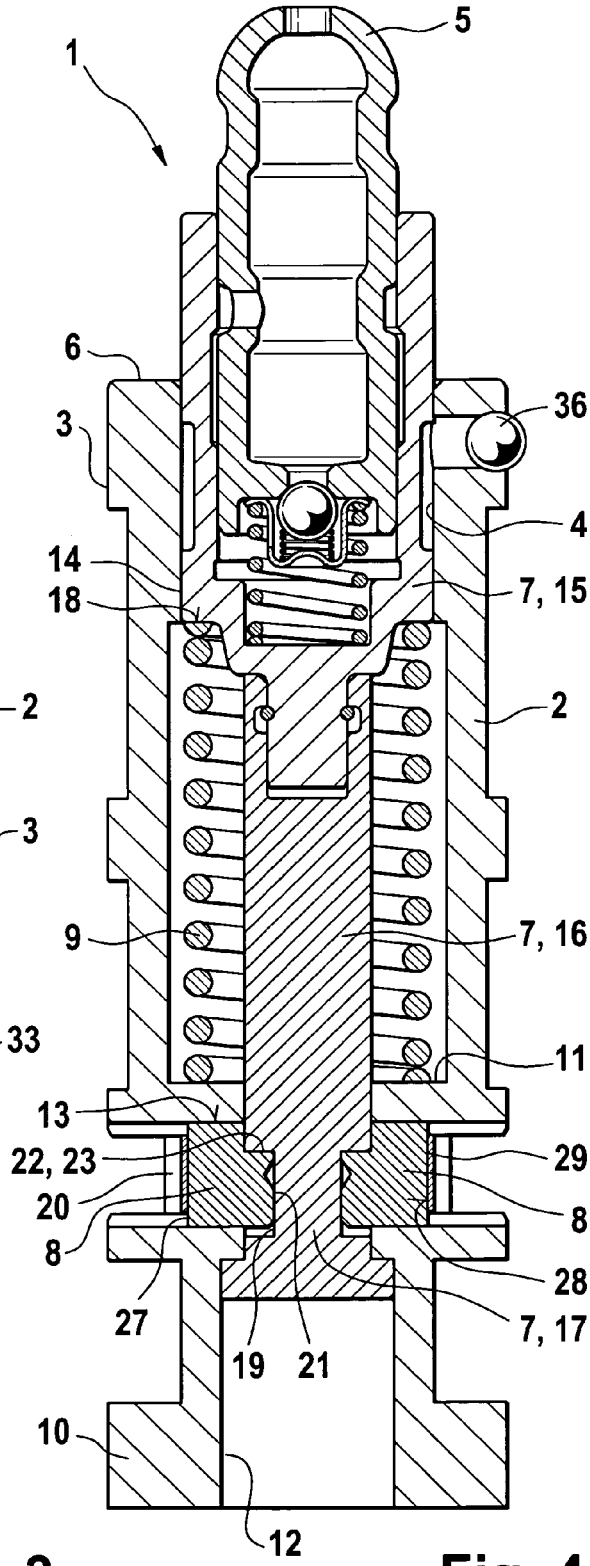
FIG. 4 shows a sectional view along line IV-IV of FIG. 2.

Further, in FIGS. 3 and 4 it can be clearly seen that one end of a lost motion spring 9 is supported on an inner side 11 of the bottom 10. This spring 9 acts at its other end against the underside 18 of the guide section 15. The spring 9 is constituted by (at least) one coil compression spring. If appropriate, a stack of coil compression springs may also be used. In order to avoid a "pumping-up" in the spring space during an uncoupling movement of the pressure piston 7 relative to the housing 2, at least one vent hole 38 leads radially out of this spring space.

The end piece 17 of the pressure piston 7 comprises an entraining surface 19 that is configured as an annular groove. FIG. 4 discloses a coupled state of the support element 1. As it can be seen, a reception/through-bore 13 extends in radial direction through the bottom 10, and two opposing slides serving as coupling elements 8 are arranged in this through-bore 13. Each of these slides 8 possesses, on its upper side 22, a flattened portion that starts from a radially inner front face 21 of the slide 8 for a face-to-face engagement with a respective upper side 22 of the annular groove 25.

Figure 2:
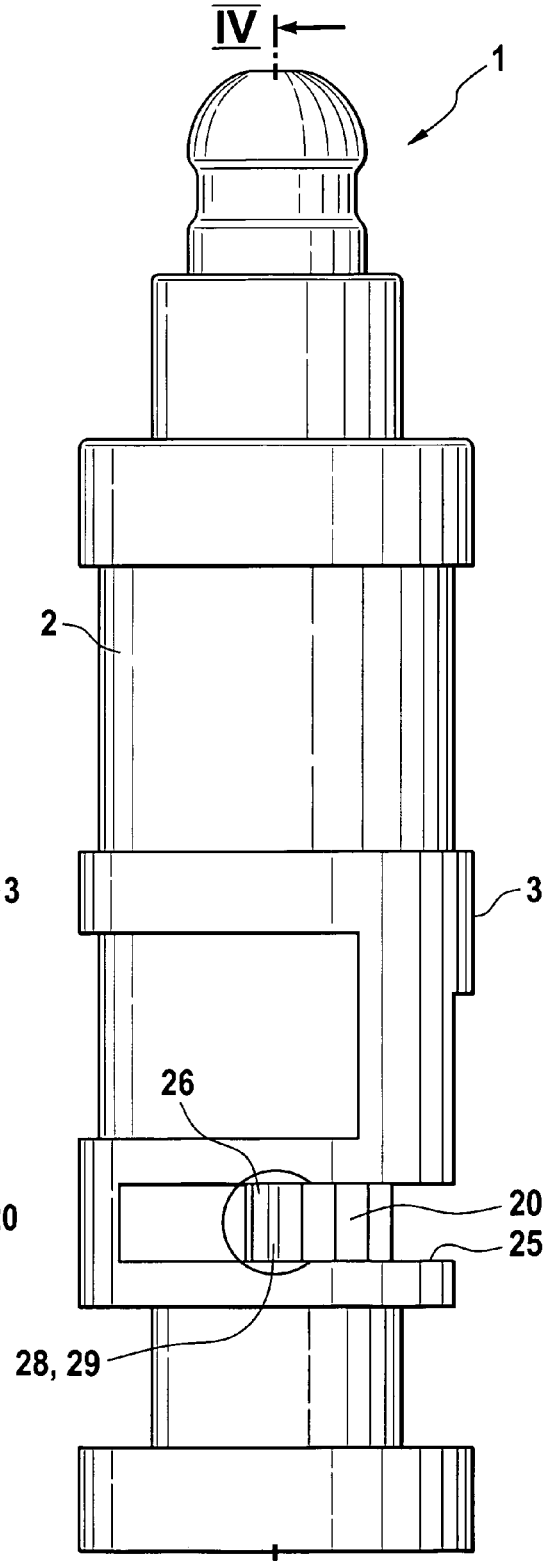
FIG. 2 is a view of the support element of FIG. 1 turned through 90°.

A radially inward displacement of the slides 8 is effected through the force of a bent spring 20 that surrounds their outer front faces 27 after the manner of a belt. As best seen in FIG. 2, the bent spring 20 advantageously extends in an annular groove 25 in the outer periphery 3 of the housing 2 and the end region 26 of the bent spring 20 acts on the radially outer front face 27.

The end regions 26 of the bent springs 20 serve at the same time as an anti-rotation device for the slides 8, in that they comprise shaped portions 29 that engage complementary counter surfaces such as longitudinal slots 28 on the outer front faces 27 of the slides 8. If appropriate, the slides 8 can be prevented from rotating through an engagement of other elements such as pins, balls etc.

A radially outward displacement of the slides 8 in their uncoupling direction is effected through hydraulic medium pressure. For this purpose, a hydraulic medium channel 33 extends, peripherally offset to the through-bore 13, through the housing 2. This hydraulic medium channel 33 opens radially inward, as disclosed in FIG. 3, into an annular space in front of radially inner front faces 21 of the slides 8.

For achieving a deactivation of the respective finger lever, for instance, at a low speed of rotation/loading of the internal combustion engine, hydraulic medium pressure is increased during the cam base circle phase, so that the slides 8 are displaced radially outward so far that their flattened portions 23 disengage the annular groove 19. As a result, the pressure piston 7 executes an idle stroke movement relative to the housing 2, and the gas exchange valve concerned thus remains closed.

FIG. 4 also discloses a simple anti-rotation device 36 for the support element 1 relative to its reception in the cylinder head. This anti-rotation device is configured in the present example in the form of a pressed-in rolling bearing ball or the like.

The aperture 12 in the solid bottom 10 of the housing 2 is preferably made as a through-bore. If appropriate, this can also be configured as a pocket bore, or the entire bottom 10 can be made as a separate component that is then connected to the rest of the housing.

LIST OF REFERENCE NUMERALS

1 Support element 29 Shaped portion
2 Housing 30 Extension
3 Outer periphery 31 Reception
4 Bore 32 Snap ring connection
5 Head 33 Hydraulic medium channel
6 Edge 34 Radial collar
7 Pressure piston 35 Annular step
8 Coupling element/Slide 36 Anti-rotation device
9 Lost motion spring 37 Lash adjuster
10 Bottom of housing 38 Vent hole
11 Inner side
12 Aperture
13 Reception/Through-bore
14 Outer periphery of guide section
15 Guide section
16 Center piece
17 End piece
18 Underside
19 Entraining surface/Annular groove
20 Spring means/Bent spring
21 Inner front face
22 Upper side
23 Flattened portion
24 Outer periphery of end piece
25 Annular groove
26 End region
27 Outer front face
28 Longitudinal slot

The invention claimed is:

1. A switchable support element for a valve train of an internal combustion engine, said switchable support element comprising a pot-shaped housing that can be arranged with an outer peripheral surface in a reception of the internal combustion engine and in whose bore an axially displaceable pressure piston extends, a head of the pressure piston projecting beyond an edge of the housing, at least one coupling element for an optional coupling of the pressure piston in an axially extended position relative to the housing being associated to the support element, and said pressure piston being biased in an outward direction from the housing by at least one lost motion spring, wherein the housing ends in a solid bottom which comprises a central aperture starting from an inner side of the housing, the aperture is intersected in radial or secant relationship by a reception of the housing comprising the at least one coupling element, the pressure piston extends with an outer peripheral surface of a head-side guide section directly in the bore of the housing, said guide section connects in bore direction to a radially reduced center piece that merges into a head-distal end piece that is guided in the aperture of the bottom, the lost motion spring surrounds the center piece while being supported at one end on the inner side of the bottom and acting at a further end against an underside of the guide section, and the end piece comprises an entraining surface for at least one coupling element for achieving coupling.

2. A support element of claim 1, wherein the reception in the bottom is configured as a through-bore in which two piston-like slides serving as coupling elements are arranged opposite each other, these slides can be displaced radially inward in coupling direction through a mechanical spring means and radially outward in uncoupling direction through hydraulic medium pressure, the coupling elements possess on their upper sides a flattened portion for a face-to-face engagement with the entraining surface, which entraining surface is configured as an annular groove/annular segment in the outer periphery of the end piece.

3. A support element of claim 2, wherein the spring means is a segmental bent spring that is peripheral guided between edges of the through-bore in an annular groove in the outer periphery of the housing, and end regions of the spring means act in the coupling direction on radially outer front faces of the slides serving as coupling elements.

4. A support element of claim 3, wherein the end regions of the bent spring further form an anti-rotation device for the slides serving as coupling elements.

5. A support element of claim 4, wherein the outer front faces of the slides comprise a recess in the form of a longitudinal slot into which a complementary shaped portion of the end region of the bent spring engages for preventing rotation.

6. A support element of claim 1, wherein the center piece and the end piece of the pressure piston are made together in one piece and have a rod-like configuration, the center piece being connected to the underside of the separate guide section.

7. A support element of claim 6, wherein a stub-like extension protrudes from one of the guide section and the center piece and is retained in a reception of the other of the guide section and the center piece.

8. A support element of claim 7, wherein, for connecting the guide section to the center piece in a region of the extension and reception, a connection as a separable connection like a snap ring connection is used.

9. A support element of claim 2, wherein, peripherally offset to the through-bore for the slides in the housing, at least one hydraulic medium channel extends from the outer periphery of the housing radially inwards into the annular groove/the annular segment for forming a pressure chamber in front of the inner front faces of the slides serving as coupling elements, for displacing the coupling elements radially outward in uncoupling direction.

10. A support element of claim 1, wherein an axial displacement limitation for the pressure piston in an axially extended position is effected through a radial collar on the end piece, which radial collar cooperates with an annular step in an aperture of the bottom of the housing under the reception comprising the at least one coupling element.

11. A support element of claim 10, wherein an adjustment of coupling lash is effected or can be effected through a variation of thickness or height on the radial collar/on the annular step.

12. A support element of claim 1 wherein the housing comprises a radially protruding element selected from the group consisting of a needle, a ball and a flattened portion, serving as anti-rotation device relative to a reception in the cylinder head.

13. A support element of claim 1, wherein the guide section of the pressure piston comprises a hydraulic lash adjuster.

* * * * *